US006313809B1

(12) United States Patent
Gabriel et al.

(10) Patent No.: US 6,313,809 B1
(45) Date of Patent: Nov. 6, 2001

(54) DUAL-POLARIZED DIPOLE ANTENNA

(75) Inventors: Roland Gabriel, Griesstatt; Maximillan Gottl, Grobkarolinenfeld, both of (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 09/622,791

(22) PCT Filed: Dec. 16, 1999

(86) PCT No.: PCT/EP99/10017

§ 371 Date: Aug. 23, 2000

§ 102(e) Date: Aug. 23, 2000

(87) PCT Pub. No.: WO00/39894

PCT Pub. Date: Jul. 6, 2000

(30) Foreign Application Priority Data

Dec. 23, 1998 (DE) ..... 198 60 121

(51) Int. Cl.[7] ..... H01Q 21/26
(52) U.S. Cl. ..... 343/797; 343/816
(58) Field of Search ..... 343/793, 797, 343/853, 810, 814, 816

(56) References Cited

U.S. PATENT DOCUMENTS

| | | | | |
|---|---|---|---|---|
| 3,740,754 | | 6/1973 | Epis . | |
| 4,062,019 | | 12/1977 | McDonald | 343/797 |
| 4,083,051 | | 4/1978 | Woodward | 343/797 |
| 4,434,425 | | 2/1984 | Normand | 343/797 |
| 5,481,272 | | 1/1996 | Yarsunas | 343/797 |
| 5,977,929 | * | 11/1999 | Ryken | 343/797 |
| 6,028,563 | * | 2/2000 | Higgins | 343/797 |

FOREIGN PATENT DOCUMENTS

| | | | |
|---|---|---|---|
| 71 42 601 | 7/1972 | (DE) | H01Q/21/24 |
| 198 21 223 A1 | 5/1997 | (DE) | H01Q/21/26 |
| 196 27 015 | 1/1998 | (DE) | H01Q/21/24 |
| 197 22 742 A | 12/1998 | (DE) | H01Q/21/24 |
| 198 29 714 A | 1/1999 | (DE) | H01Q/21/16 |
| 0 457 500 B1 | 7/1995 | (EP) | H01Q/25/00 |
| 0 685 900 A1 | 12/1995 | (EP) | H01Q/9/04 |

OTHER PUBLICATIONS

"Einsatz von dual polarisierten Basisstationsanten–nen bei GSM 1800"—1998.

* cited by examiner

*Primary Examiner*—Don Wong
*Assistant Examiner*—Hoang Nguyen
(74) *Attorney, Agent, or Firm*—Nixon & Vanderhye P.C.

(57) ABSTRACT

Dual-polarized dipole radiator which comprises a plurality of individual dipoles which are preferably arranged upstream of a reflector (33) and form a dipole square structurally in top view, each dipole (111–114) being fed by means of a symmetrical line (115–118), characterized by the following further features:

the dual-polarized dipole radiator radiates electrically in a polarization at an angle of +45° or −45° to the structurally prescribed alignment of the dipoles (111–114);

the end of the symmetrical or substantially or approximately symmetrical lines leading to the respective dipole halves (111*a* to 114*b*) are connected up in such a way that the corresponding line halves (115*a* to 118*b*) of the adjacent, mutually perpendicular dipole halves (114*b* and 111*a*; 111*b* and 112*a*; 112*b* and 113*a*; 113*b* and 114*a*) are always electrically connected; and the electric feeding of the respectively diametrically opposite dipole halves is performed in a decoupled fashion for a first polarization and a second polarization orthogonal thereto.

25 Claims, 5 Drawing Sheets

DUAL-POLARIZED DIPOLE ANTENNA

The invention relates to a dual-polarized dipole radiator according to the preamble of claim 1.

It is known that two orthogonal polarizations can be emitted or received by means of dual-polarized antennas. If the two systems are connected up appropriately, they can also be used to emit or receive any other desired combinations of the linear orthogonal polarizations such as, for example, a circular polarization.

Dual polarized antennas normally have dipole radiators, patch radiators or slot radiators as primary radiators. With dipole radiators, it is essentially the dipole square, comprising four individual dipoles, and a turnstile dipole arrangement which are included as structures. The said radiators can thereby be operated both horizontally and vertically, as well as with a polarization alignment at an angle of ±45°. In this case, one also speaks, for example, of an X-polarized antenna, as is known in principle from DE 1296 27 015.

There are problems with such types of dual-polarized antennas when, for example, the aim is to implement half-widths of less than approximately 75° in conjunction with a compact antenna design. In this case, it is possible to implement dual-polarized antennas virtually only by means of dipole squares and/or by using very wide reflectors. This is associated with a not inconsiderable wiring outlay. Thus, for example four cables have to be used for feeding the dipoles. The large antenna dimensions are also disadvantageous, however, particularly owing to the wide reflectors which are required.

A further disadvantage consists, in particular in the case of ±45°-polarized dipole antennas, in that there is a relatively high coupling in the case of an array arrangement comprising dipole squares. This relatively high coupling has a disturbing effect, particularly in the case of antennas with a tunable phase relationship of the dipoles (adjustable electric downtilt).

A further embodiment of dual-polarized radiators has been disclosed, for example, in EP 0 685 900 A1. This is a slot radiator which can be appropriately excited. However, the limiting dimensioning of the slot/feed coupling required in this case renders it possible to implement small half-widths only by means of correspondingly large reflectors even in the case of this known prior art.

Starting from the prior art mentioned at the beginning, it is therefore the object of the present invention to create a dual-polarized dipole radiator which is of simple design and, in particular, has an improved decoupling even in the case of an array design when use is made of a plurality of dual-polarized radiator modules.

The dual-polarized dipole radiators according to the invention are of simpler design by comparison with conventional solutions, with the result that the dipole radiators according to the invention can be produced more cost-effectively, for one thing.

However, they also exhibit a completely surprisingly structure which differs from conventional solutions which yield improved values for decoupling, chiefly in the implementation of an antenna array.

What is surprising is that the dual-polarized dipole radiators according to the invention act electrically like a turnstile dipole, but more resemble a dipole square in terms of mechanical design.

It is furthermore surprising that, given dipole components which are aligned horizontally and vertically, the antenna module which more resembles a dipole square in terms of its spatial design results electrically in an X-polarized antenna module, in other words an antenna radiating electrically at ±45°.

If, by contrast, the antenna is to radiate or receive in a polarized fashion in the horizontal and/or vertical direction, that is to say the turnstile dipole is to be aligned electrically with its electric dipole axes in the horizontal and vertical directions, it would be necessary for the module, which more resembles a dipole square in terms of design, to be aligned with the individual dipole components in a ±45° direction.

The invention provides for this purpose that each of the four dipoles is fed by a symmetrical line, and that owing to the special type of interconnection the mutually orthogonal adjacent dipole halves of two adjacent dipoles are respectively excited in phase. These symmetrical or at least essentially or approximately symmetrical feed lines comprise two line halves which, viewed individually, constitute an asymmetric line with respect to a fictitious zero potential. The interconnection of the asymmetric line halves is performed according to the invention in such a way that the two line halves leading to two adjacent dipole halves aligned in a mutually orthogonal fashion are electrically interconnected in each case. The feeding of the resulting overall radiator is performed in this case in a crosswise fashion. That is to say, the two connected line halves, respectively mentioned above, of two mutually perpendicular dipole halves are respectively electrically interconnected in a crosswise fashion with the two line halves of the diametrically opposite adjacent and mutually orthogonal dipole halves, preferably in a crosswise fashion. The overall radiator therefore acts electrically rather like a turnstile dipole, the lines proceeding from the middle not also radiating, or doing so only negligibly owing to their special design. It is possible to this extent to interpret the respectively mutually orthogonal adjacent dipole halves, which are excited in phase, after all, as part of a resulting turnstile dipole. For this reason, the radiator designed according to the invention is also designated as a resulting turnstile dipole. It is not completely surprising that a wideband high decoupling is achieved between the feed points in the first polarization and in the second polarization, which is orthogonal thereto.

The abovementioned symmetrical feed lines connected to the respective dipole halves are preferably of symmetrical design, resulting in the preferred symmetrical line arrangement since, as mentioned, the associated line halves are arranged per se asymmetrically relative to one another with respect to a zero potential and are fed in antiphase. The advantages according to the invention are, of course, still achieved in this case whenever the symmetrical feed line is not 100% symmetrical, but deviates therefrom, the degree of decoupling decreasing with increasingly stronger deviation from the symmetrical design of the feed lines.

In a preferred embodiment of the invention, the respective line half, leading to the dipole, of the symmetrical feed line is constructed as a mechanical holder of the dipole halves, and said holder is situated or terminates preferably at the same distance above the reflector at which the dipole itself is fitted above the reflector. This line can therefore also be interpreted as part of the resulting turnstile dipole, but owing to the antiphase currents on the line halves said line does not radiate, or does so only slightly. This results, therefore, in the desired elimination of the radiation activity and thus in a better focusing of the dipoles. Consequently, it is completely surprising that the corresponding connecting-up in a crosswise fashion at the feed point then results, on the one hand, in emission of the polarization lying in a ±45° plane and, on the other hand, in a wideband high decoupling.

The symmetrical feed lines are preferably arranged with their in each case two asymmetric line halves such that in a top view of a radiator arrangement said line halves proceed from a balun situated approximately in the middle and lead to the respective two connecting points of two dipole halves situated in an axial extension with respect to one another. These feed lines can, however, also be arranged in a fashion running completely differently. For example, it is also possible to lead these line halves of the symmetrical feed line from the rear side of a reflector plate through the latter, the line halves leading, for example, approximately perpendicular to the plane of the reflector plate directly to the connecting points, located thereabove, of the dipole halves respectively situated in an axial extension. The holding device for the dipole halves can likewise be constructed completely separately from the line halves connected to the dipole halves.

The respectively two mutually perpendicular half dipole components are usually arranged such that they respectively point with their free ends to a common intersection which forms the corner points of a square. The components of the dipole halves need not be structurally connected here, but they can be. In this case, the components can be metallic or can be connected by using insulators which are seated at the corner points of the abovementioned square.

The invention is explained in more detail below with the aid of exemplary embodiments. In this case, in detail:

Figure 1:
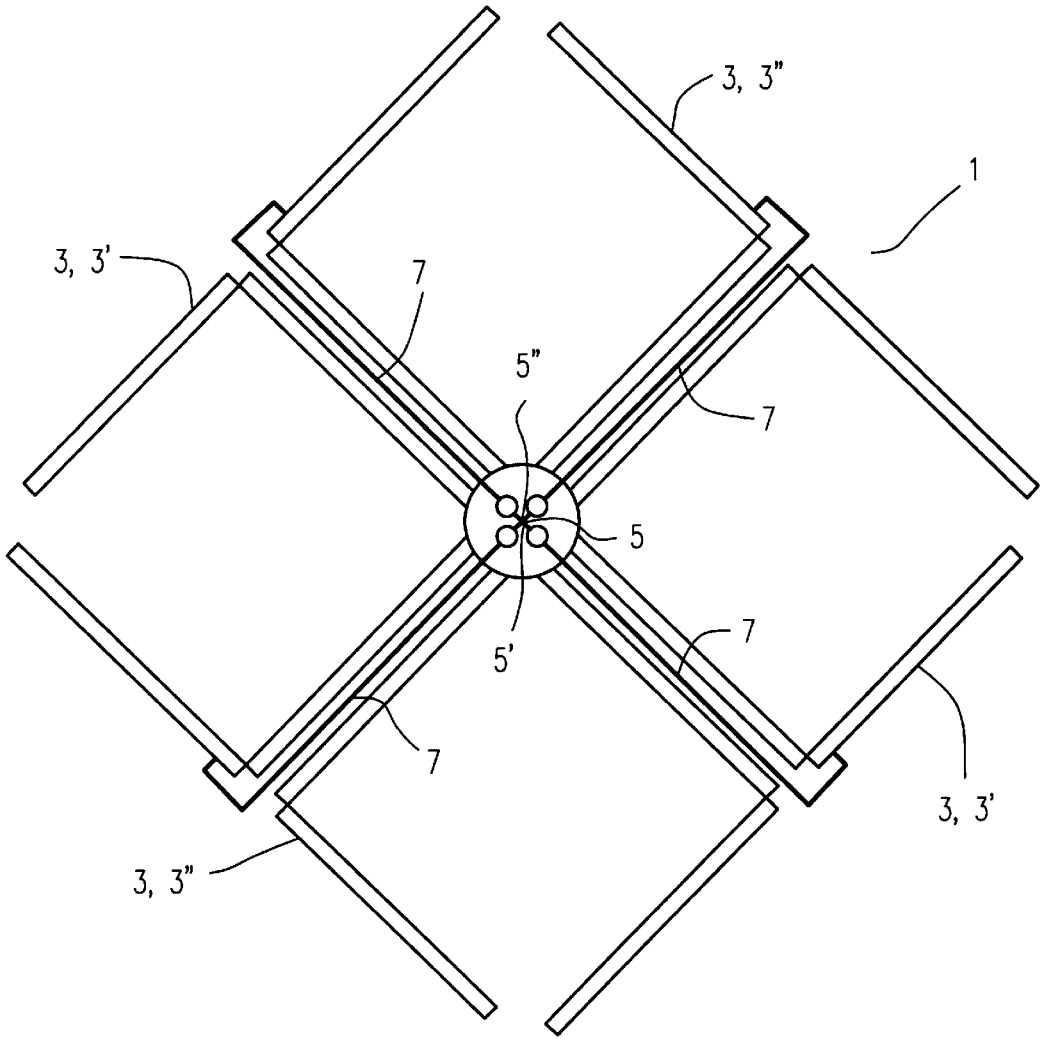
Fig.1 (PRIOR ART)
FIG. 1 shows a diagrammatic top view of a dipole square according to the prior art.

In order to illustrate the differences according to the invention from a conventional dual-polarized dipole radiator, reference is firstly made to FIG. 1, in which a dual-polarized dipole radiator 1 of this type is shown in the form of a dipole square.

The dipole radiator 1, known according to the prior art, in accordance with FIG. 1 is designed such that its dipoles 3 can receive or emit linear polarizations at an angle of +45° and −45° referred to the vertical or horizontal. Such antennas or antenna arrays are also designated for short as X-polarized antennas or antenna arrays.

In accordance with FIG. 1, first dipoles 3" in a −45° alignment and second dipoles 3' in a +45° alignment are provided in a fashion respectively situated offset from the axial center point 5 of the antenna arrangement. It is indicated in FIG. 1 diagrammatically that in this case the two opposite dipoles 3' and 3", respectively, are combined in each case to form a double dipole. As a result, a total of four connecting lines 7 are required in order to undertake feeding of the two polarizations starting from the center point 5, that is to say from the feed or interconnection points 5' and 5", respectively, situated in the region of the center point 5.

Figure 2:
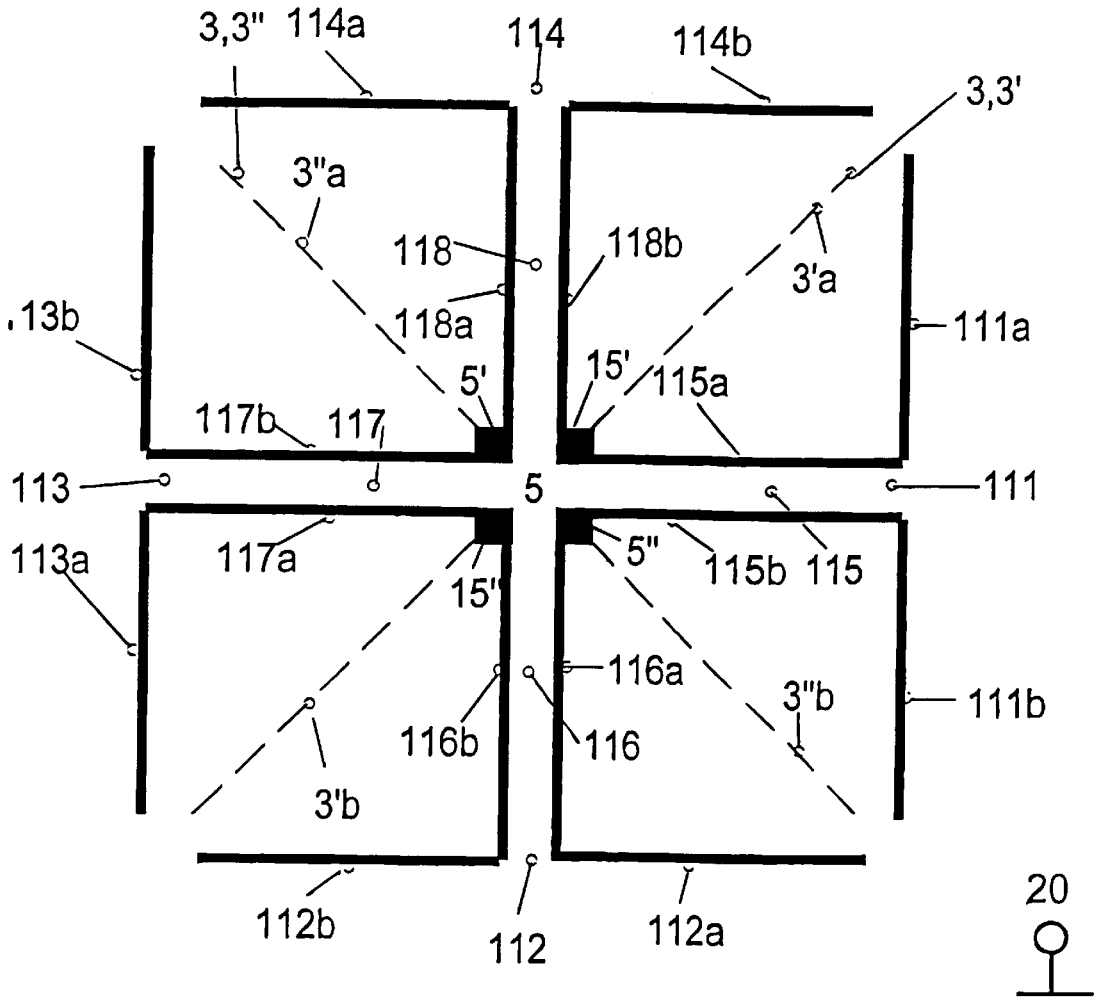
FIG. 2 shows a diagrammatic top view of a dual-polarized dipole radiator according to the invention with an electric polarization of ±45°.
Figure 3:
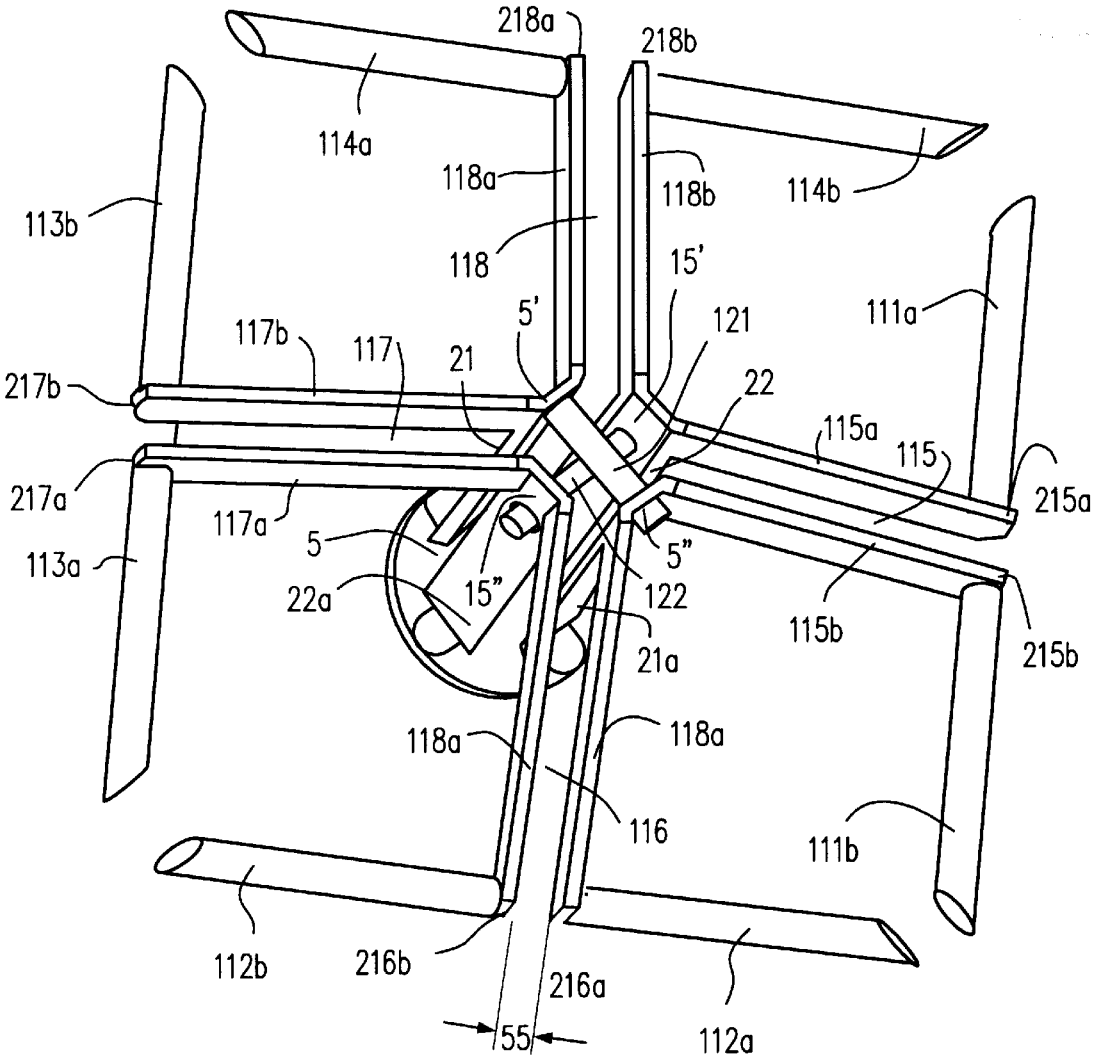
FIG. 3 shows a perspective illustration of an exemplary embodiment, shown in concrete terms, of a dipole radiator according to the invention.
Figure 4:
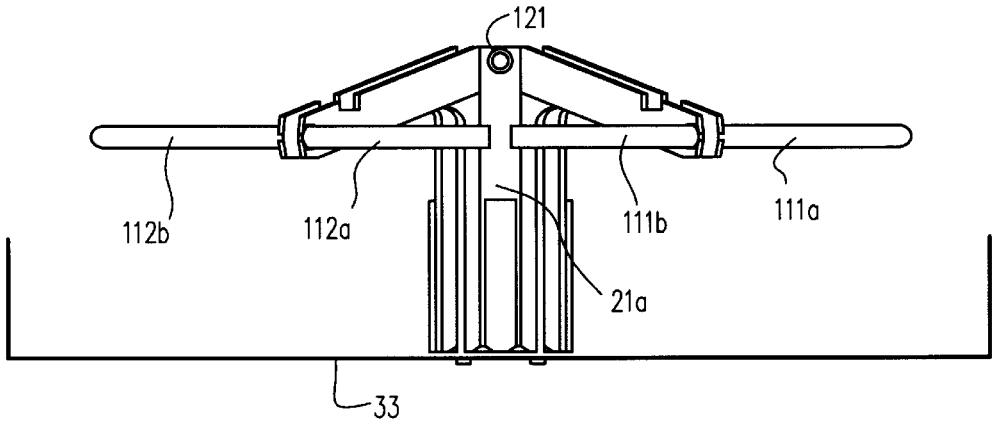
FIG. 4 shows a diagrammatic side view of the dual-polarized dipole radiator according to the invention.

A first exemplary embodiment provided by the invention of a dual-polarized dipole radiator is now shown with the aid of FIGS. 2 to 4.

As discussed further in detail below, the dipole radiator illustrated in FIG. 2 acts electrically like a dipole radiating with a polarization of ±45°, that is to say as a turnstile dipole, for example. The radiator acting electrically as a turnstile dipole 3 is drawn in with dashes in FIG. 2. This radiator acting electrically as a turnstile dipole 3 and having a ±45° alignment with respect to the horizontal is formed by an electric dipole 3' (inclined in a +45° direction) and, perpendicularly thereto, a dipole 3" (inclined at −45° with respect to the horizontal). Each of the two electrically formed dipoles 3' and 3" respectively comprises the associated dipole halves 3'*a* and 3'*b* for the dipole 3' as well as the dipole halves 3"*a* and 3"*b* for the dipole 3". Structurally, in this case the electrically resulting dipole half 3'*a* is formed by two mutually perpendicular half dipole components 114*b* and 111*a*. In the exemplary embodiment shown, the half dipole components 114*b*, 111*a* terminate with their ends, running toward one another at right angles, at a distance from one another. However, they could also be connected there, specifically both by an electrically conducting, metallic connection, and by inserting an electrically nonconducting element or insulator, in order, for example, to ensure higher mechanical stability. It is also possible further to provide the ends of the dipole halves with bends.

In a corresponding fashion, the dipole half 3"*b*, which is next in the clockwise direction, of the electric dipole 3" provided electrically with a −45° alignment is formed by the two half dipole components 111*b* and 112*a*. The second dipole half 3'*b* formed in an extension relative to the dipole half 3'*a* is formed by the two half dipole components 112*b*, 113*a* and the fourth dipole half 3"*a* is formed analogously by the two half dipole components 113*b*, 114*a*.

The half dipole components arranged as a dipole square are now fed by respectively one symmetrical feed line 115, 116, 117 or 118. In this case, the two half dipole components 114*b* and 111*a*, for example, that is to say in each case the adjacent mutually orthogonally aligned half dipole components, are excited in phase via a common feed point, here the feed point 15'. The connecting lines belonging to these half dipole components 114*b*, 111*a* respectively comprise two line halves 118*b* and 115*a* which, viewed individually, constitute an asymmetric line with respect to a fictitious zero potential 20. In a corresponding fashion, the two nearest half dipole components 111*b* and 112*a* are, for example, electrically connected to their common feed point 5" via the line halves 115*b* and 116*a*, respectively, etc. In the case of this connecting-up, the respectively associated symmetrical feed line is simultaneously shaped such that it takes over the mechanical fixing of the dipoles, that is to say the half dipole components. In this case, for example, of the symmetrical line 115 one asymmetric line half 115*a* bears the dipole half 111*a*, and the second line half 115*b*, which runs preferably parallel and is electrically separated from the line half 115*a* bears the second dipole half 111*b*. In other words, thus, in each case the two associated asymmetric line halves belonging to a symmetrical line 115 to 118 bear in each case the two dipole halves, arranged in an axial extension relative to one another, of a dipole 111 to 114. By virtue of the fact that the line halves which lead to the respectively adjacent mutually orthogonal dipole halves are connected in an electrically conducting fashion at their feed point, four interconnection points 15', 5", 15", 5' are produced which are fed, in turn, symmetrically in a crosswise fashion, as follows, in particular, from the illustration in accordance with FIG. 5. The overall radiator resulting therefrom now acts electrically like a turnstile dipole owing to the in-phase excitation of the half dipole components 114*b*, 111*a* or the half dipole components 111*b* and 112*a* or 112*b* and 113*a* or 113*b* and 114*a*. The specific arrangement of the line halves which are arranged in each case parallel to one another at a slight distance with the current flowing therein in antiphase ensures that the line halves themselves do not deliver any appreciable radiation contribution, any radiation thus being extinguished by overlapping.

The basic design in a top view of the radiator arrangement in accordance with FIG. 2 shows that the radiator module has a fourfold symmetry in top view. Two mutually perpendicular axes of symmetry are formed by the symmetrical lines 115 and 117 or 112 and 118, the third and fourth axis of symmetry in a top view of the radiator arrangement in accordance with FIG. 2 moreover being situated rotated by 45° and being formed by the dipoles 3' and 3" which result electrically.

Furthermore, FIG. 3 also shows at the feed and interconnection point 51 the respective one part of the balun 21 and, at a slight distance opposite relative to the center point 5, the other part of the balun 21*a* which, on the one hand, serves to fasten the dipole structure mechanically to the reflector plate and, on the other hand, permits the transition to asymmetric feed lines (for example coaxial lines) at the interconnection point.

It is shown correspondingly, particularly in FIG. 3, that the interconnection point 15' for the half dipole components 114*b* and 111*a* as well as the opposite interconnection point 15" for the half dipole components 112*b* and 113*a* is formed in the region of the balun 22 and 180° or opposite thereto in the case of the balun 22*a*, which likewise once again on the one hand serves the purpose of fastening the dipole structure mechanically to a rear reflector plate 33 and, on the other hand permits the transition to the asymmetric feed line (for example coaxial line) at the interconnection point. In this case, it is to be seen very well in FIG. 3, in particular, how the electric feeding is performed via a crossover circuit with a first circuit bridge 121 and a second circuit bridge 122, offset by 90° thereto, on the respectively opposite baluns 21 and 21*a* or 22 and 22*a*, respectively. The circuit bridges 121 and 122 last mentioned are arranged at a vertical distance relative to one another, that is to say are not interconnected electrically.

It is also to be gathered in this case from FIG. 3 that, for example, the pin-shaped bridge 122 is fitted firmly mechanically on the half of the balun 22 situated at the rear in FIG. 3, and is connected there electrically to the balun 22, whereas the opposite free end of this pin-shaped bridge projects through a bore, of appropriately larger dimensions, through the front half of the balun 22*a*, without being electrically connected to this balun 22*a*. This opens up the possibility of leading up a coaxial cable in front of the balun 22*a* for feeding purposes, of connecting the outer conductor electrically to a suitable point on the balun, and of connecting the inner conductor at the fee end of the bridge 121 and effecting the feeding thereby. The second parts of the bridge 121 is also correspondingly designed, that is to say is fitted mechanically with its rear end on the balun 21 and electrically connected thereto, whereas the opposite free end projects through a bore of larger dimension without making electric contact via the balun 21*a* situated front right in FIG. 3. There, the second coaxial cable can be laid, coming from below, parallel to the balun, for example, the outer conductor can be connected electrically to the balun, and the inner conductor can be connected to the free end of the pin-shaped bridge 121.

It may be mentioned merely for the sake of completeness that other connection possibilities are likewise also possible, for example, in such a way that an inner conductor is led upward from below between the respective baluns, and is then connected electrically at a suitable point on the upper end of an assigned balun, in order to permit symmetric feeding thereby. The outer conductor can also be led via a part of this section, or can already be electrically conducted lower down to the respectively opposite half of the balun. The possible transformations of the feeding are thus explained only by way of example.

In other words, the feeding is thus performed in a crosswise fashion between the feed points 5', 5" and 15', 15", respectively. The abovementioned electric line halves 115*a* to 118*b* are respectively arranged in this case symmetrically relative to one another in pairs, that is to say the adjacent electric line halves of in each case two adjacently situated half dipole components run parallel to one another at a comparatively short distance, this distance preferably corresponding to the distance 55 between the ends, respectively pointing toward one another, of the associated dipole halves, that is to say, for example, the distance between the ends pointing toward one another, of the dipole halves 111*a*, 111*b* etc. It is fundamentally possible in this case for the line halves to run parallel to a rear reflector plate in the plane of the half dipole components. In a departure from this, the exemplary embodiment in accordance with FIGS. 2 and 3 shows a design in the case of which the line halves, which also constitute the holder device for the half dipole components, are mounted falling slightly starting from their assigned balun and terminate at the level of the half dipole components, which can be arranged parallel to a rear reflector plate 33. This is associated with the wavelength region of the electromagnetic waves to be transmitted or received, since the height of the balun above the reflector plate 33 is intended to correspond to approximately $\lambda/4$ and, if appropriate, it can be desirable with reference to the radiation pattern that the dipoles and dipole halves are to be arranged closer opposite the reflector plate 33.

Consequently, on the basis of this arrangement a dipole always acts simultaneously for the +45° and the −45° polarization, although in a departure from the three-dimensional geometrical alignment of the individual half dipole components in the horizontal and vertical direction the resulting +45° polarization or −45° polarization, in other words, thus, the X-polarized turnstile dipole radiator 3 drawn in electrically in FIG. 2 is not produced until the radiator components are combined. The basis for the mode of operation is that the currents on the feed or connecting lines situated respectively adjacent and parallel to one another, that is to say, for example, on the electric lines 115*a*, overlap in terms of phase with the current on the electric line 115*b* and the current on the line 116*a* with that on the electric line 116*b* etc. such that the latter do not also radiate, or do so only slightly; at the same time, the superimposition of the currents at the feed points produces a decoupling of the feed points (5', 5") from the feed points (15', 15").

Figure 5:
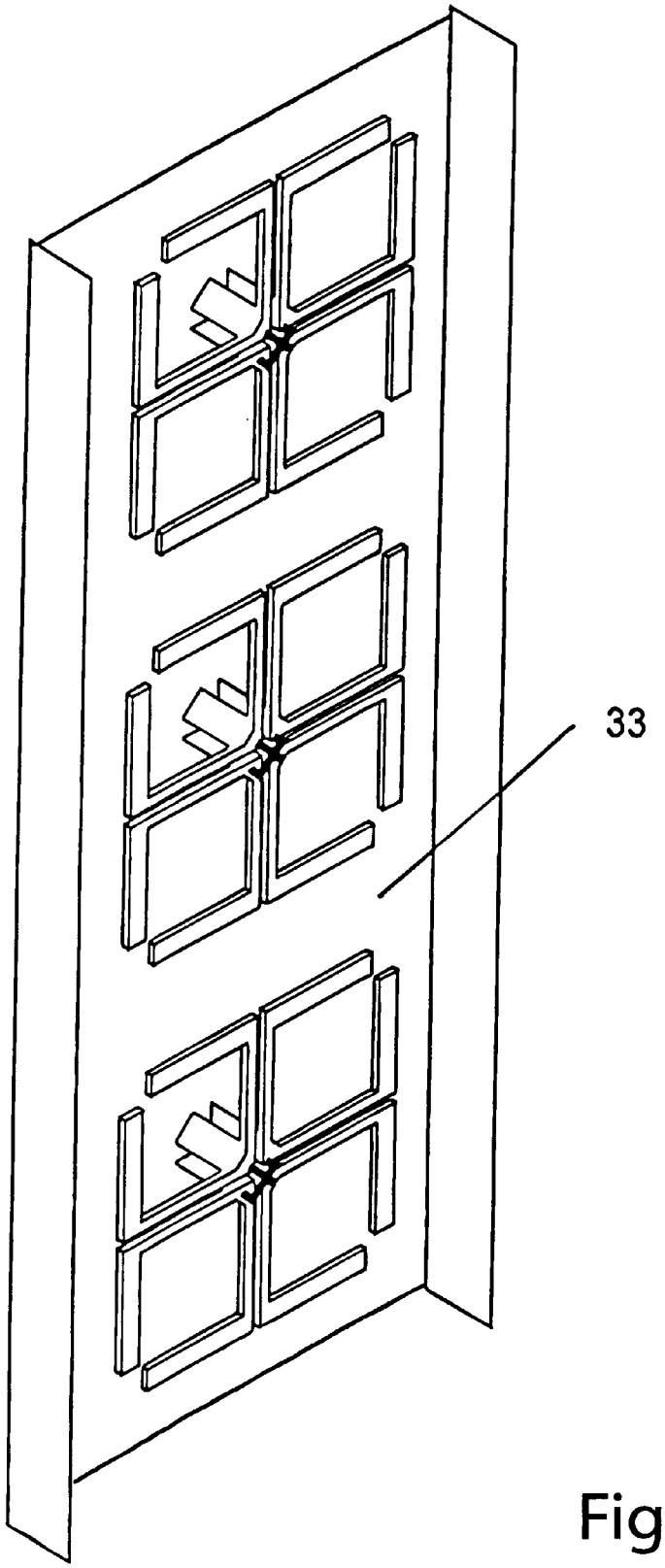
FIG. 5 shows a diagrammatic top view of an antenna array with a plurality of dual-polarized dipole radiators according to FIGS. 1 and 2.

It is illustrated with the aid of FIG. 5 that it is also possible by making use of a dual-polarized dipole radiator 1 explained with the aid of FIGS. 2 to 4 to design an appropriate antenna array with a plurality of dipole radiators 1 which are arranged, for example, one above another in a vertical fitting direction and which describe altogether an antenna with an electric polarization of +45° and −45° despite the horizontally and vertically aligned half dipole components.

The radiator arrangements shown in FIG. 5 are in each case arranged with their associated balun on a reflector plate 33 which are [sic] provided in the fitting direction of the individual radiator modules on the opposite sides with electrically conducting edges 35 running perpendicular to the reflector plane.

In a departure from the exemplary embodiment according to FIGS. 2 to 5, it is, however, equally possible to undertake the electric feeding on the dipole halves not in the region of the balun and the line halves electrically fastened on the balun 21, 21*a* or 22, 22*a* and simultaneously performing the holding function. In a departure from this, it is possible that the elements 115*a* to 118*b* denoted in FIGS. 2 to 5 are constructed only as nonconducting bearing elements for the dipole halves, and the symmetrical lines 115 to 118 takes place [sic] directly from below through the reflector plate 33 to the connecting ends 215*a*, 215*b*, 216*a*, 216*b*, 217*a*, 217*b* and 218*a*, 218*b*. Finally, it is likewise conceivable that in such a case the bearing elements 115*a* to 118*b* for the dipole halves are configured completely differently structurally, and are arranged running in a different way, for example to run [sic] from the connecting points 215*a* to 218*b* onto the reflector 33 vertically or obliquely downward starting from the middle of the dipole halves or from the corner region of the respectively mutually perpendicular dipole halves, and are mechanically anchored there.

Furthermore, it is also conceivable in a deviation from this that the reflector itself is constructed as a printed circuit board, that is to say, for example, as the top side of a printed circuit board, on which the overall antenna arrangement is built up. The corresponding feeding can be undertaken on the rear of the printed circuit board, the electric line halves running on a suitable path, starting therefrom, to the above-mentioned connecting points 215*a* to 218*b*. To achieve as good a radiation pattern as possible, it is required only to ensure that irrespective of the way in which they are led to the connecting points on the dipole halves, these line halves are aligned parallel to one another as far as possible, that is to say substantially or at least approximately, in other words that a symmetrical line is substantially or approximately produced.

What is claimed is:

1. Dual-polarized radiator arrangement comprising a plurality of dipoles which are arranged to form a dipole square, a plurality of substantially symmetrical feed lines that feed the plurality of dipoles, wherein the radiator arrangement formed in the shape of a dipole square is connected in such a way and fed in such a way that the dipole square radiates electrically in two polarization planes simultaneously which are mutually perpendicular and run parallel to the two mutually perpendicular diagonals formed by the dipole square.

2. Radiator arrangement according to claim 1, characterized by the following further features one dipole half of each of the plurality of dipoles is electrically connected to the dipole half of another one of the plurality of dipoles adjacent and perpendicular, thereto, each symmetrical feed line comprises two line halves, and the electric connection between mutually perpendicular and adjacent dipole halves is provided via a line half of the associated symmetrical line respectively comprising two line halves, and the electric feeding of the dipole halves which are respectively diametrically opposite relative to the center of the dipole square, is performed in a decoupled fashion with reference to the mutually orthogonal polarizations.

3. Radiator arrangement according to claim 1, characterized in that in electrical terms a dipole half is respectively formed structurally from a pair of dipole halves which are aligned in a mutually perpendicular fashion and situated adjacent to one another, and are jointly fed electrically.

4. The dual-polarized radiator arrangement of claim 1 wherein the plurality of individual dipoles are arranged upstream of a reflector to structurally form the dipole square in top view, each dipole of the plurality of dipoles being fed by an associated symmetrical feed line, wherein:

the dual-polarized dipole radiator radiates electrically in a polarization at an angle of +45° or −45° to the structurally prescribed alignment of the dipoles;

the ends of the substantially symmetrical lines leading to the respective dipole halves are connected up in such a way that the corresponding line halves of the adjacent, mutually perpendicular dipole halves are always electrically connected; and the electric feeding of the respectively diametrically opposite dipole halves is performed in a decoupled fashion for a first polarization and a second polarization orthogonal thereto.

5. The dual-polarized radiator arrangement of claim 1 which comprises a plurality of individual dipoles are arranged upstream of a reflector and structurally form a dipole square in top view, each dipole being fed by said substantially symmetrical line wherein:

the dipole radiator electrically comprises a turnstile dipole and structurally simulates a dipole square, the electrically respectively single dipole half is structurally formed respectively from two half dipole components which are aligned in a mutually perpendicular fashion and are respectively electrically fed via an electric line half; and in each case two adjacent line halves, which serve to fed two adjacent half dipole components mutually aligned in an axial extension, are respectively arranged with a lateral offset running parallel or substantially or approximately parallel to one another.

6. Radiator arrangement according to claim 1, characterized in that the characteristic impedance of the substantially symmetrical feed lines for feeding the dipoles is not constant along the line.

7. Radiator arrangement according to one of claim 1, characterized in that the substantially symmetrical feed lines for feeding the dipoles comprise a plurality of sections with different characteristic impedances.

8. Radiator arrangement according to one of claim 1, characterized in that the spacing of the dipoles from a reflector is smaller than $\lambda/4$.

9. Radiator arrangement according to one of claim 1, characterized in that the ends of the half dipole components, which are mutually orthogonal, are mechanically connected.

10. Radiator arrangement according to claim 9, characterized in that the mechanical connection of the dipole ends is electrically conducting.

11. Radiator arrangement according to one of claim 1, characterized in that the dipole radiators are arranged to form an array.

12. Radiator arrangement according to one of claim 1, characterized in that the respectively interconnected half dipole components are simultaneously operated in both orthogonal polarizations.

13. Radiator arrangement according to one of claim 1, characterized in that the feeding with reference to the respectively electrically interconnected line halves with reference to the associated mutually orthogonal dipole halves is performed in a crosswise fashion in each case between the corresponding interconnection points of the respectively diametrically opposite line halves.

14. Dipole radiator according to one of claim 1, characterized in that the feeding with reference to the respectively opposite halves of the balun is performed by an electrically conducting bridge not in mutual electric contact, which is respectively mechanically held with one of its ends on the associated half of the balun and is electrically connected to the other half of the balun, and projects with its respective opposite free end through a bore in the associated opposite half of the balun for leading through an electric feed.

15. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the symmetrical feed lines are formed from in each case two identical asymmetric line halves.

16. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that, the symmetrical feed lines simultaneously form the mechanical holder of the dipoles.

17. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the symmetrical feed lines lie in the same plane as or a plane parallel to that of the dipoles, which is located upstrearm of a reflector.

18. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the symmetrical feed lines are arranged running inclined to a reflector plate and are aligned falling at least slightly in the direction of the dipoles to be fed.

19. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the interconnection of the symmetrical feed lines is provided on the side of the reflector averted from the dipoles.

20. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the interconnection point of the symmetrical feed lines is transformed by a balun coupled to an asymmetric feed cable.

21. Radiator arrangement according to claim 20, further characterized in that the balun serves simultaneously as a mechanical holder of the symmetrical feed lines and/or the dipoles.

22. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, further characterized in that the ends of the half dipole components, which are mutually orthogonal, are mechanically connected, and the mechanical connection of the dipole ends is electrically nonconducting.

23. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the interconnection of the dipoles is performed by a printed circuit.

24. Dual-polarized radiator arrangement, having the following features the radiator arrangement comprises a plurality of dipoles which are arranged in top view with the formation of a dipole square, each dipole is fed by means of a symmetrical line, characterized by the following further features:

the radiator arrangement formed in the shape of a dipole square is connected up in such a way and fed in such a way that the dipole square radiates electrically in two polarization planes which are mutually perpendicular and run parallel to the two mutually perpendicular diagonals formed by the dipole square, characterized in that the feeding with reference to the respectively opposite halves of the balun is performed by an electrically conducting bridge not in mutual electric contact, which is respectively mechanically held with one of its ends on the associated half of the balun and is electrically connected to the latter, and projects with its respective opposite free end through a bore in the associated opposite half of the balun for leading through an electric feed, and wherein at the respective free end of the bridge the electric feed is performed by means of the electric contact with an electric conductor, in particular the inner conductor of a coaxial cable, the outer conductor of the coaxial cable preferably making electric contact with the half of the balun not making electric contact with the associated bridge.

25. A dual-polarized radiator arrangement comprising:

four dipoles arranged in dipole square, the dipole square simultaneously radiating electrically in both a +45° polarization and a −45° polarization with respect to at least one axis, a feed line arrangement coupled to the four dipoles, the feed line arrangement including a first set of adjacent and parallel feed line conductors and a further set of feed line conductors, the first set of feed line conductors overlapping in terms of phase with the current of the further set of feed line conductors such that the further set of feed line conductors do not also radiate, wherein the first set of feed line conductors is connected to the dipole square at a first set of feed points, the second set of feed lines is connected to the dipole square at a second set of feed points, and the first and second set of feed points are decoupled from one another due to superposition of currents.

* * * * *